US006604335B1

(12) United States Patent
Henderson et al.

(10) Patent No.: US 6,604,335 B1
(45) Date of Patent: Aug. 12, 2003

(54) COLUMN GUARD

(75) Inventors: Douglas Stewart Henderson, Harrowsmith (CA); Stephen Ambrose Doyle, Amherstview (CA); Jamie Medeiros Pascoal, Kingston (CA)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 09/936,084

(22) PCT Filed: Apr. 19, 1999

(86) PCT No.: PCT/US99/08570

§ 371 (c)(1),
(2), (4) Date: Sep. 6, 2001

(87) PCT Pub. No.: WO00/63496

PCT Pub. Date: Oct. 26, 2000

(51) Int. Cl.[7] ..... E04C 3/30
(52) U.S. Cl. ..... 52/737.5; 52/736.4
(58) Field of Search ..... 52/736 A, 737.5, 52/737.2

(56) References Cited

U.S. PATENT DOCUMENTS

| | | | | |
|---|---|---|---|---|
| 1,995,874 A | * | 3/1935 | Van De Mark | 20/99 |
| 3,092,529 A | | 6/1963 | Pearson | 154/44 |
| 3,212,529 A | | 10/1965 | Ullman et a. | 138/141 |
| 3,251,382 A | | 5/1966 | Tatsch | 138/151 |
| 3,410,474 A | | 11/1968 | Keil | 229/14 |
| 3,939,665 A | | 2/1976 | Gosse et al. | 61/54 |
| 4,453,353 A | | 6/1984 | Killop et al. | 52/147 |
| 4,748,060 A | | 5/1988 | Fry et al. | 428/36 |
| 5,006,386 A | | 4/1991 | Menichini | 428/58 |
| 6,357,196 B1 | * | 3/2002 | McCombs | 52/736.2 |

FOREIGN PATENT DOCUMENTS

| | | | | |
|---|---|---|---|---|
| DK | 4224548 | | 1/1994 | E01F/15/00 |
| EP | 0780518 | | 6/1997 | E01F/1/00 |
| FR | 2419385 | * | 3/1978 | E05F/5/06 |
| FR | 2419385 | | 10/1979 | E05F/5/06 |
| WO | 9321392 | | 10/1993 | E02B/17/00 |

* cited by examiner

*Primary Examiner*—Carl D. Friedman
*Assistant Examiner*—Steve Varner
(74) *Attorney, Agent, or Firm*—David L. King

(57) ABSTRACT

The invention is a "column guard" for vertical structural beams or columns (100). The column guard (10) is an annulet (20) that encircles the beam and is clamped thereto by means of a threaded fastener. The preferred method of attaching the column guard (10) includes positioning the device at a height of less than 30 inches, preferably about 18 inches above the floor.

11 Claims, 5 Drawing Sheets

COLUMN GUARD

TECHNICAL FIELD

This invention relates to structural guards, bumpers and the like for vertical columns, preferably columns, having two or more flat surfaces.

BACKGROUND OF THE INVENTION

Along roads and highways we often see "guardrails" around circular columns supporting "overpasses". These column guardrails are designed to keep the vehicle from squarely impacting the column during a vehicular accident Similarly in the marinas, column guards are often placed above and below the water to prevent boats from colliding into the supporting columns of a dock. U.S. Pat. No. 3,939,665 shows a device for such column protection.

In modern factories and warehouses small lifts, pallet or skid carrying vehicles are moving around numerous columns. Normally, the columns in such buildings are steel made of an "H" or "I" cross-sections. To avoid "column collisions" with these pallet-laden vehicles, small guardrails are often employed at the intersections of the vehicle pathways or isleways. In these areas where vehicles must negotiate a turn, accidents are most likely to occur. Elsewhere in the straight areas of the isleways, no guards are used because collisions are far less common and the guard railing is too bulky and intrusive.

The most relevant prior art patent found during the prior art search is FR-A-2 419 385 of Pierre Lamige which disclosed an annulet for vertical columns. The annulet has an annular ring having a rounded peripheral surface and a radially inner surface.

An interesting problem associated with column collisions in a building is that pedestrian traffic is often involved in the accident. When a forklift laden with a pallet collides with a column, structural damage can occur, however, when a person is unfortunately caught between the columns and a vehicle, serious injury or death may result.

Many times the worker, using a hand truck or lift, can inadvertently pinch his hand between the column and the truck resulting in an injury.

While it is clearly understood that accidents can and do occur, it seems that the best course to avoid such accidents is proper training and safety awareness. Another very valuable accident prevention concept involves risk elimination or risk reduction devices.

The present invention provides a column guard and a method of installation that precludes colliding vehicles from contacting the column directly. This column "guard" minimizes pinch points that are common in conventional guardrails and when properly installed in close proximity to the floor, 30 inches (76 cm) or less above the ground preferably at about 1 foot (30 cm), the guard provides a means to absorb collision energy and minimizes column damage.

The column "guard" of the present invention is extremely easy to install, takes up minimal space, and is sufficiently low in cost to justify attaching to any column wherein vehicular traffic can occur.

DISCLOSURE OF THE INVENTION

Summary of the Invention

An annulet (20) for vertical columns (100) is disclosed. The annulet (20) has an annular or penannular ring (22) with a rounded peripheral surface (23) and a radially inner surface (21), and a pair of segments (24), each segment (24) being juxtaposed and extending from an opposite side of the annular ring (22) toward the center of the annulet (20) to a channeled end (25). The channeled ends (25) have a channel width and a channel depth. The channel width is equal to or superior to the width of a flat side (102) of the column (100) to which the annulet (20) encircles.

In a preferred embodiment, the annular or penannular ring (22) is formed of two substantially semi-annular portions or ring halves (22A, 22B). Each ring half (22A, 22B) has a vertical oriented inwardly extending column locking tab (30) traversing the radially inner surface (23). The column locking tabs (30), when bolted together secures the annulet (20) about the column (100) to which the annulet (20) encircles by clamping the column between said channeled ends (25) of the segments (24).

The method of providing a column guard (10) on a structural vertical column (100) has the steps of placing an annulet (20) around a column (100), the annulet (20) having two opposing channeled segments (24), positioning each opposing channeled segment (24) to align with a flat portion (102) of the column (100), adjusting the height of the annulet (20) to be less than 30 inches above the floor level to which the column is attached to greater than 6 inches above the floor level, and then securing the annulet (20) to the column (100).

The steps of securing the annulet (20) to the column includes tensioning the annular or penannular ring (22) of the annulet (20) to secure the annulet (20) to the column.

The steps of placing an annulet (20) around a column (100) can include taking two ring halves (22A, 22B), each ring half (22A, 22B) having a channeled segment (24) and attaching them around the column (100) to form the annulet (20).

DETAILED DESCRIPTION OF THE INVENTION

Figure 1:
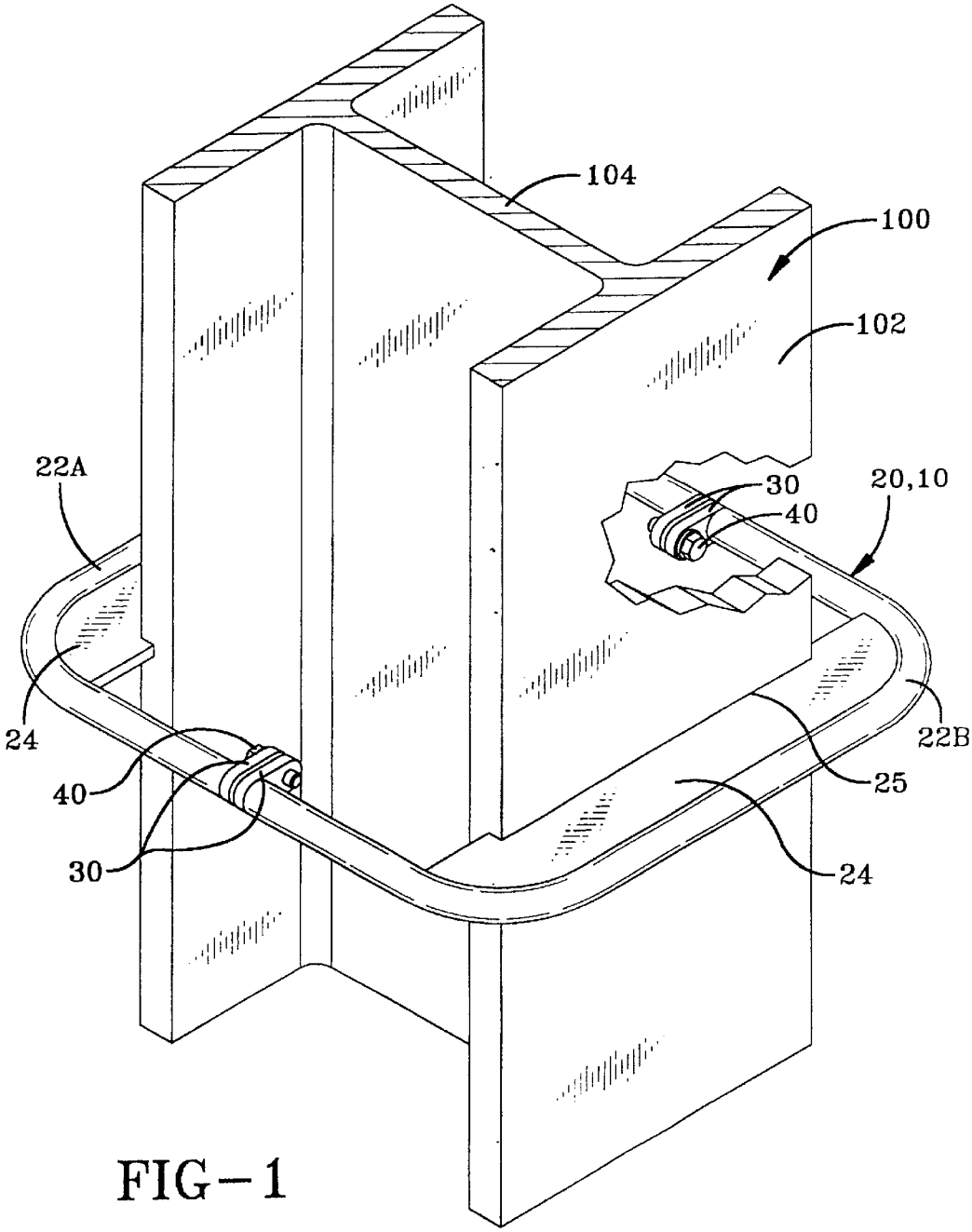
FIG. 1 is a perspective view of the preferred embodiment column guard of the present invention attached to a structural column.
Figure 2:
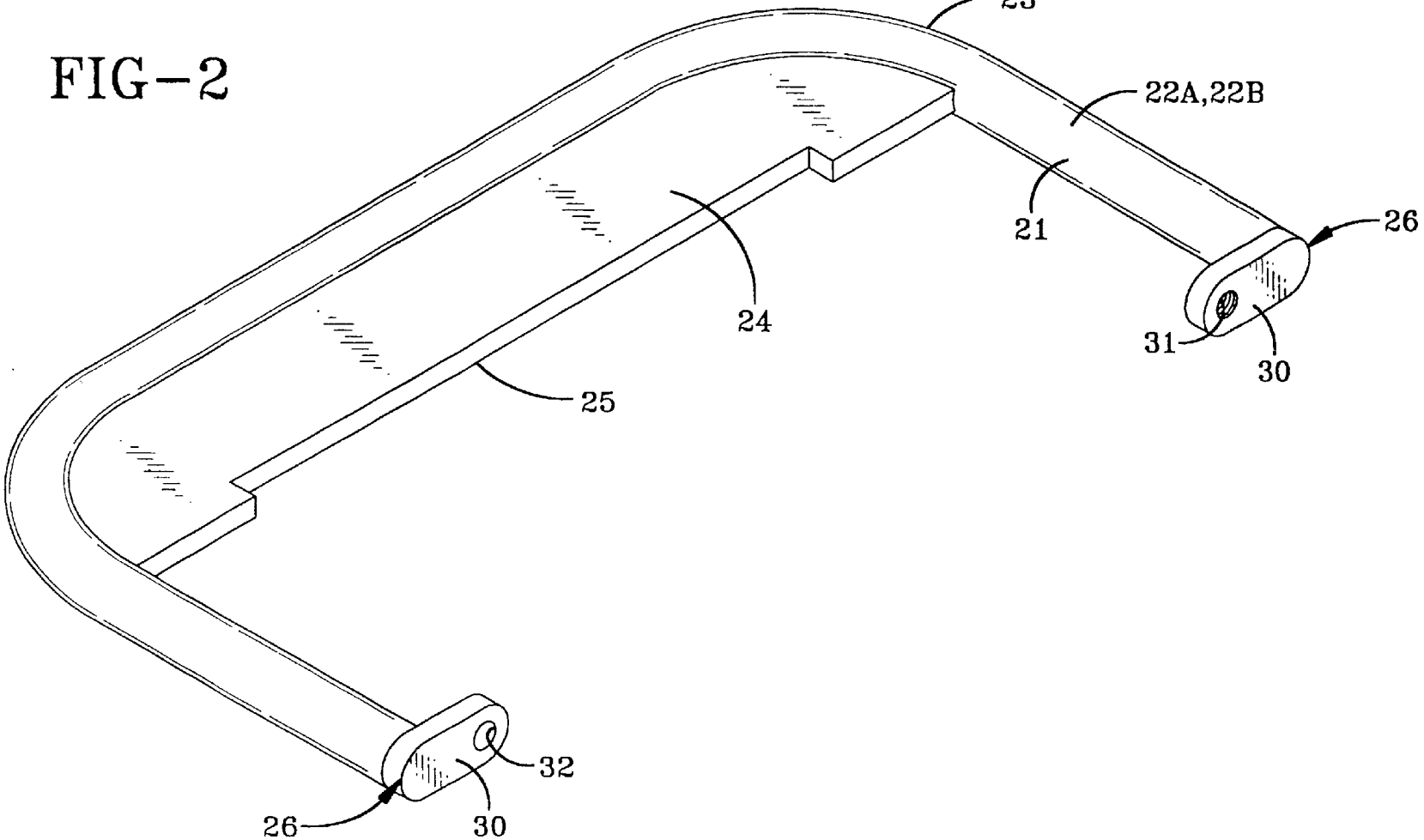
FIG. 2 is a perspective view of a ring half of the column guard of the present invention taken from FIG. 1.

With reference to FIG. 1, a column guard (10) is shown encircling a structural column (100).

The column guard (10) forms an annulet (20) for vertical columns. The annulet (20) has an annular or penannular ring (22) having a rounded peripheral surface (23).

As used herein, "annulet" (20) means to encircle a vertical column. As shown the annulet (20) can be circular, oblong or even square or rectangular in shape as long as each bend of the annulet (20) has a radius of curvature. Fundamentally, the annulet (20) when encircling a column (100) surrounds the column in 360°. In the preferred embodiment, the annulet (20) is formed in two portions, each portion occupying 180° or slightly less of the encircling perimeter. The portions have a resultant shape that will represent half of the annulet (20). For ease of manufacture, the two pieces or portions are preferably identical. As used herein, the term "ring halves" (22A, 22B) simply refers to the fact the portion of the annulet (20) extend about 180° or less around a column. The actual shape of the portion may be half of an oval, an oblong, a square or rectangular shape as noted above.

The annulet (20) preferably is formed by joining two separate ring halves (22A) and (22B). Each ring half has a segment (24) affixed to the radially inner surface (21) of the ring halves (22A, 22B). These segments (24) extend toward the center of the annulet (20). When the two ring halves are joined together around a column, a channeled end (25) of each segment (24) preferably contacts a flat side (102) of the column (100) to which the annulet (20) encircles. This direct contact against the column (100) provides a very strong impact absorbing design.

As shown the sides of the annulet (20) adjacent the web portion (104) of an I or H types column (100) can have ends (26), each end (26) preferably has a rigid tab (30) extending inwardly toward the web (104). Each tab (30) has a hole (31, 32), preferably one hole (31) is threaded to accept a threaded fastener (40). Alternatively, both holes (31, 32) can be clearance holes for accepting a threaded fastener (40). These tabs (30) when fastened together provide tension in the annulet (20) halves (22A, 22B) securing the channeled ends (25) into firm contact with the column (100).

Figure 5:
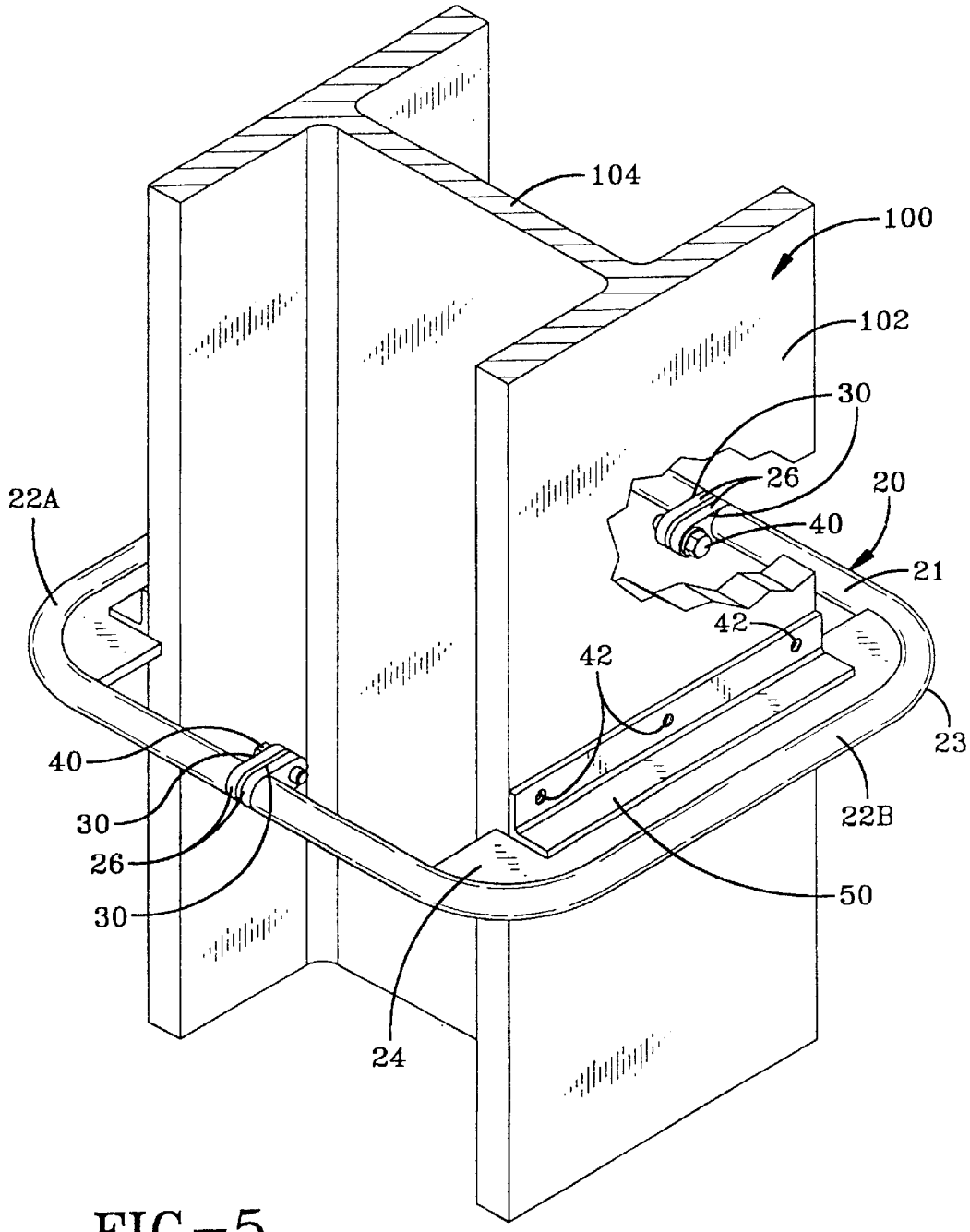
FIG. 5 is a perspective view of a "column guard" mounted onto a damaged I beam with angle supports attached to the beam.

In an alternative installation as shown in FIG. 5, it has been found that pre-existing columns may have bent or damaged flanges in those applications. Each annulet (20) may have the segments (24) positioned between two spaced right-angled members (50), the right angle member (50) being secured to the column by threaded fasteners (42).

As shown, the threaded fasteners (42) are believed to be a preferred means to secure the right angled members (50) because they provide a very good way to support the annulet (20) without diminishing the columns strength. Welding the segments (24) to a column (100) can be considered if the welding does not detrimentally affect the column strength.

As shown, the annulet (20) may be circular or oblong in a shape dependent on the beam or column size. In large structural beams, the annulet (20), preferably may be square or rectangular with rounded corners as shown in FIGS. 1 through 5.

In manufacturing the annulet (20), it is believed most preferred to use one inch (2.5 cm) diameter steel rod bent to the desired shape of one half ring (22A, 22B) of the annulet (20). Then, welding the segment (24) with a channeled end (25) to the inner surface (21) of the bent rod. At each end of the rod, a tab (30) is welded. On one end, the tab (30) may have a threaded hole (31) and at the opposite end, the tab may have a clearance hole. One important feature of the annulet (20) design is to insure that the two semi-annular portions or ring halves (22A, 22B) of the annulet (20) are slightly shorter around the perimeter of the beam or column (100) so that the ends (26) do not meet when joined. In this regard, the threaded fasteners (40), when tightened, tension the ring halves (22A, 22B) and lock the channeled segments (24) against the beam or column (100).

One of the principle features of the annulet (20) is to provide a clearance to avoid collisions from directly impacting the columns (100).

While this invention has clear advantages for people and equipment, it also minimizes structural damage to the beams and the building due to the fact that the annulet (20) is located close to the floor where the column (100) is securely anchored.

Figure 3:
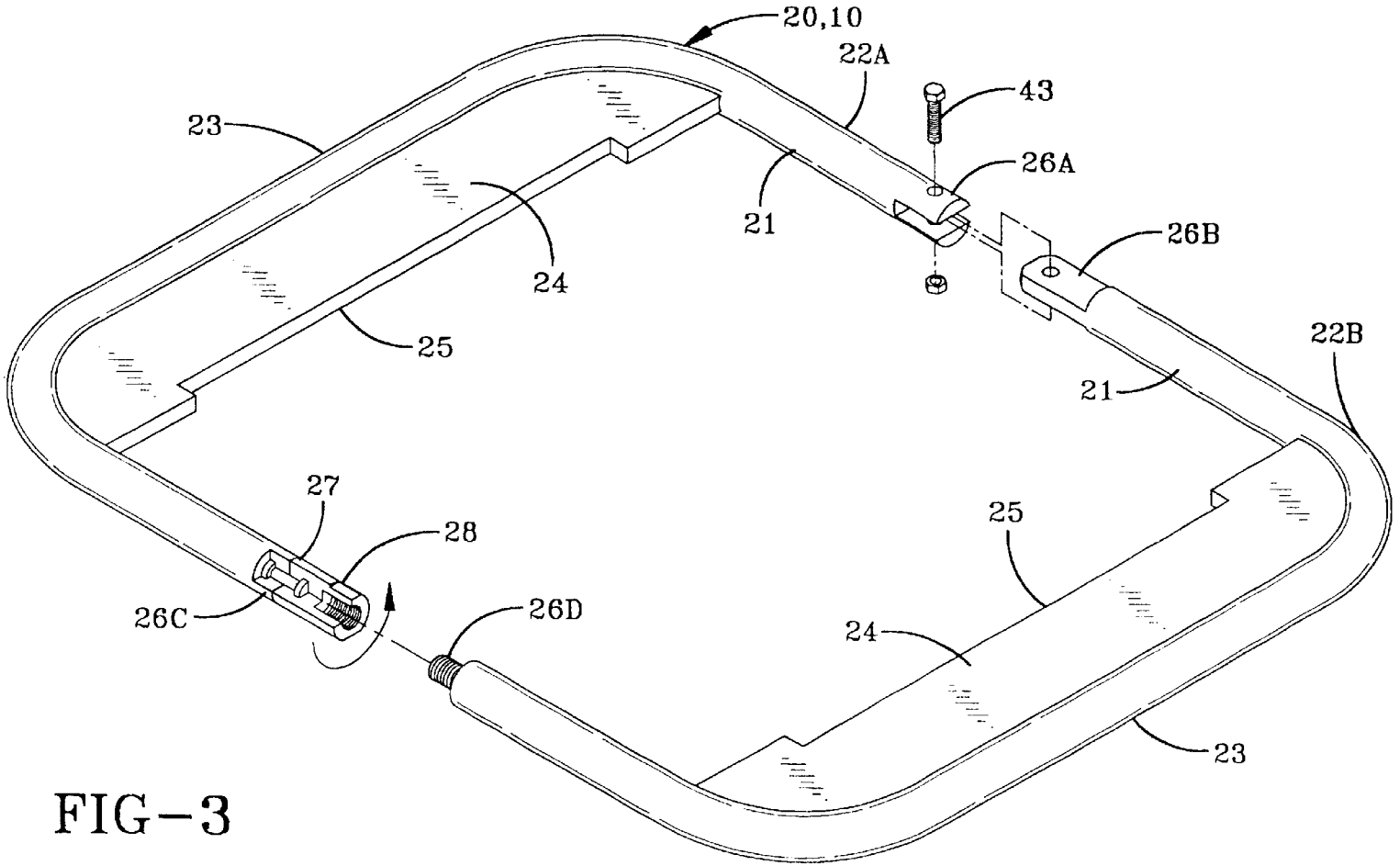
FIG. 3 is a perspective view of an alternative embodiment of the "column guard" invention wherein the column guard has the two ring halves pivotally joined at one side of the annulet (20) and having a captive threaded coupling and an opposing threaded end at the opposite side of the annulet (20).
Figure 4:
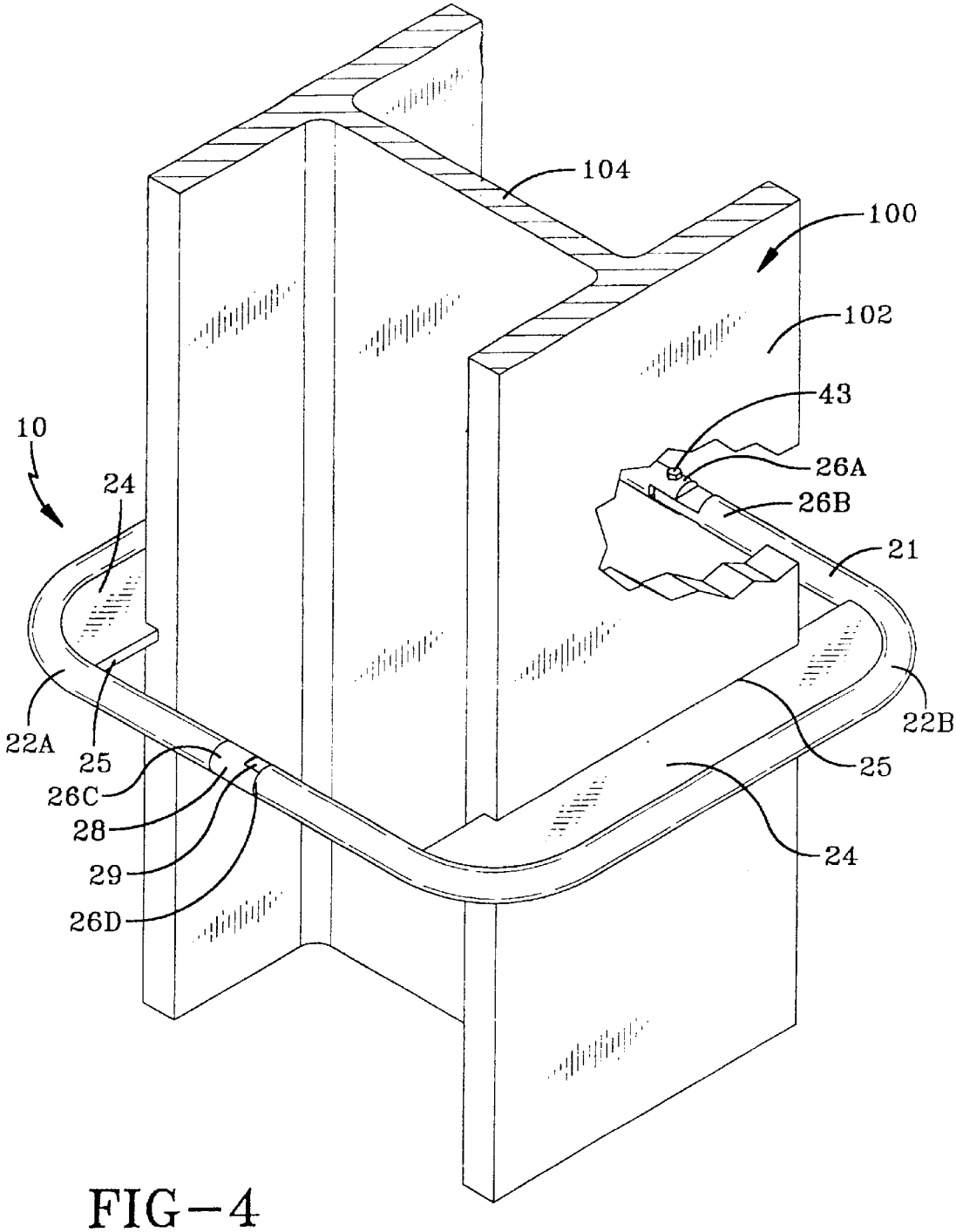
FIG. 4 is a perspective view of the alternative column guard of FIG. 3 attached to the column showing the captive threaded coupling threaded onto the threaded end thereby tensioning the annulet (20) to the column.

As shown in FIGS. 3 and 4 an alternative column guard (10) is shown. The annulet (20) has most of the same features of the preferred annulet (20) of FIGS. 1 and 2. Ring halves (22A, 22B) each have segments (24) with the channeled ends (25). The rounded peripheral surface (23) and the inner surface (21) are also the same. The ends (26), however, are different.

At ends (26A and 26B), as shown, the rings halves have semicircular cross-sections or flat cross-sections each with a hole for accepting a rivet or other type fastener (43). Preferably as shown, the ends (26A and 26B) are pivotally joined.

At the opposite ends (26C and 26D) the end (26C) has an integrally attached threaded coupling (28). The end (26C) preferably has a flanged portion (27) to secure the coupling (28). The coupling (28) may include a flat (41) to facilitate fastening to the threads (29) of end (26D).

When attaching the annulet (20) around a column, one simply pivotally opens the annulet (20) and positions it around the beam or column (100). Then, the coupling (20) is threaded onto the thread of end (26D) as the coupling advances onto the threads, the channeled segments (24) engage the columns (100) firmly griping and securing the annulet (20) to the column at the channeled ends (25). By designing the ends (26C and 26D) of the annulet (20) not to meet or contact until or unless a sufficient clamping pressure is insured, the annulet can be quickly and simply attached to a column (100).

What is claimed is:

1. An annulet for vertical columns, the annulet comprising:

an annular or penannular ring, the annular or penannular ring having a rounded peripheral surface and a radially inner surface; the annulet characterized by:

a pair of segments, each segment being juxtaposed and extending from opposite side of the annular ring toward the center of the annulet to a channeled end, the channeled end having a channel width and a channel depth, the channel width being equal to or superior to the width of a flat side of the column to which the annulet encircles, the annulet being attached only to the column and located close to but spaced above the floor where the column is securely anchored to provide a clearance to prevent collisions from directly impacting the columns.

2. The annulet of claim 1 wherein the annular or penannular ring is formed of two substantially ring halves.

3. The annulet of claim 2 wherein each ring half has a vertical column locking tab traversing inwardly from the radially inner surface.

4. The annulet of claim 3 wherein the column locking tabs when fastened together secure the annulet about a column between said channeled ends.

5. The annulet of claim 2 wherein the ring halves when joined are placed into tension.

6. The annulet of claim 2 wherein the ring halves are pivotally joined at one pair of ends.

7. The annulet of claim 6 wherein the ring halves are joined at ends by means of a threaded fastener thereby tensioning the ring halves.

8. The annulet of claim 6 wherein the ring half at an end has a threaded coupling and ring half at an end has a threaded end.

9. A method of providing a column guard on a structural vertical column, the method comprising the steps of: (i) placing an annulet around column, the annulet having two opposing channeled segments; (ii) positioning each opposing channeled segments to align with a flat portion of the column; (iii) adjusting the height of the annulet to be less than 30 inches (76 cm) above the floor level to which the column is attached to greater than 6 inches (15 cm) from the floor level; securing the annulet to the column, the annulet providing a clearance to avoid collisions from directly impacting the column.

10. The method of providing a column guard on a structural column of claim 9, the method wherein the steps of securing the annulet to the column includes tensioning annular or penannular rings of the annulet to secure the annulet to the column by clamping the channeled ends of segments against the column.

11. The method of providing a column guard on a structural vertical column of claim 10 when the steps of placing an annulet around a column further includes taking two ring halves, each ring half having a channeled segment and attaching them around the column to form the annulet.

* * * * *